United States Patent [19]

Nikitas

[11] 4,408,822

[45] Oct. 11, 1983

[54] COAXIAL CONNECTORS

[75] Inventor: Nick C. Nikitas, Danvers, Mass.

[73] Assignee: Delta Electronic Manufacturing Corp., Beverly, Mass.

[21] Appl. No.: 189,668

[22] Filed: Sep. 22, 1980

[51] Int. Cl.[3] ..... H01R 11/20

[52] U.S. Cl. ..... 339/177 R; 339/95 R

[58] Field of Search ..... 339/95 R, 177 R, 177 E, 339/178–180

[56] References Cited

U.S. PATENT DOCUMENTS

| | | | |
|---|---|---|---|
| 1,370,789 | 3/1921 | Delano | 339/178 X |
| 4,093,335 | 6/1978 | Schwartz et al. | 339/177 E |
| 4,135,776 | 1/1979 | Ailawadhi et al. | 339/177 R |
| 4,255,011 | 3/1981 | Davis et al. | 339/177 R |
| 4,296,986 | 10/1981 | Herrmann, Jr. | 339/177 E X |

*Primary Examiner*—Joseph H. McGlynn

*Attorney, Agent, or Firm*—Maurice R. Boiteau

[57] ABSTRACT

There is disclosed in the present application, a coaxial connector adapted to being mounted on a coaxial cable including a central conductor, a dielectric, a generally braided outer conductor and a rubber or plastic jacket. The connector of the present application includes a central cone insertable between the dielectric and the outer conductor, and an externally threaded sleeve or ferrule interiorly threaded to engage the jacket of the cable and thus provide not only a watertight joint but also resistance to withdrawal of the cable from the connector.

8 Claims, 6 Drawing Figures

COAXIAL CONNECTORS

The present application relates generally to improvements in coaxial connectors and more particularly to connectors intended for service where there is a need for a weatherproof joint between the connector and the cable on which it is installed. In addition, the present invention relates, in one aspect, to connectors which are intended to withstand rough usage in that the connector is frequently disassembled or otherwise stressed in its coupling with a mating connector.

Various coaxial connector applications are complicated by the fact that the cables which they terminate are frequently disconnected from and reconnected to the mating connector in the course of what is considered normal usage. Frequently, the separation of the connectors is accomplished by pulling on the cable, thus placing a severe stress on the junction between the cable and the connector. Sometimes, whether or not there is frequent disassembly, the junction between the cable and connector is stressed sufficiently to cause mechanical and electrical failure at the junction. The problems of securing connectors to the ends of cables so as to withstand substantial forces are further complicated by the fact that very often, the junction which must withstand the forces must also remain weatherproof. Adding still further to the problem of a structurally resistive junction is the fact that any appreciable departure at the junction from the uniform dimensions of the cable, causes an increase in the voltage standing wave ratio (vswr) which is particularly objectionable as signal frequency is increased.

It is accordingly an object of the present invention to improve the mechanical or structural strength of joints between coaxial cables and connectors which terminate them.

Another object is to provide a weatherproof joint between coaxial cables and connectors and to do so in such a manner that the weatherproof condition is retained in spite of stresses applied to the junction of the cable and connector.

Still another object is to accomplish the previous objects without appreciably increasing the voltage standing wave ratio at the junction between cable and connector.

In the achievement of the foregoing objects, a feature of the invention relates to the use of a collar which is threaded both internally and externally and a conical bushing formed with annular spurs to anchor the cable to the connector assembly. In the usual installation, the present connector is installed on the end of a coaxial cable comprising a central conductor, a generally braided outer conductor, an insulator between the conductors and an outer sheath of rubber or plastic, which performs the dual functions of sealing the body of the cable against weather and adding to the mechanical strength of the cable. The conical bushing, in addition to its function of anchoring the cable to the connector assembly also provides an electrical link between the outer conductor and a conductive shell forming a part of the connector assembly. In accordance with another feature of the present invention, the external thread of the collar engages a threaded opening in the connector body while the internal thread of the collar is penetrating the sheath to obtain superior anchoring of the connector to the cable. In order to present the sheath to the interior of the collar to be engaged by the thread, the conical bushing is inserted under the outer conductor. The sheath at the end of the cable is thus enlarged to be engaged by the internal thread which is tapered and relatively shallow. An important advantage flowing from the present construction is that generally, the end of the sheath need not be slit or otherwise prepared before the connector assembly is installed on it.

The foregoing objects and features of the present invention will be better understood and appreciated from the following detailed description of an illustrative embodiment taken in connection with the accompanying drawings in which.

Figure 1:
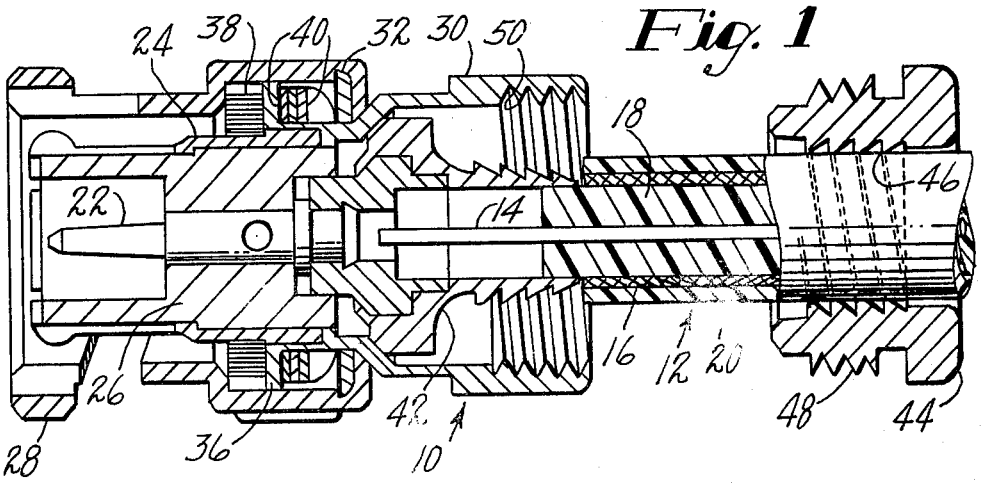
FIG. 1 is a view in longitudinal section of a connector according to the present invention and a coaxial cable upon which it is about to be installed.
Figure 2:
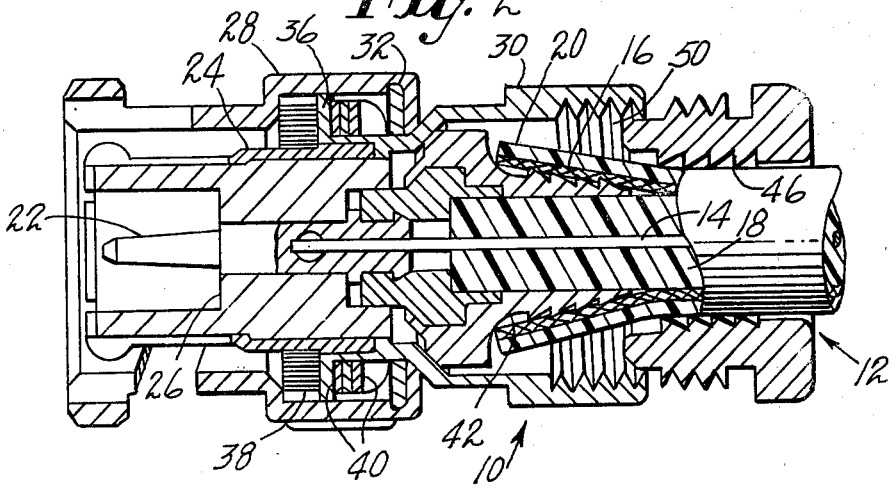
FIG. 2 is a view also in longitudinal section of the connector and cable of FIG. 1 but showing the connector partially installed on the end of the cable.
Figure 3:
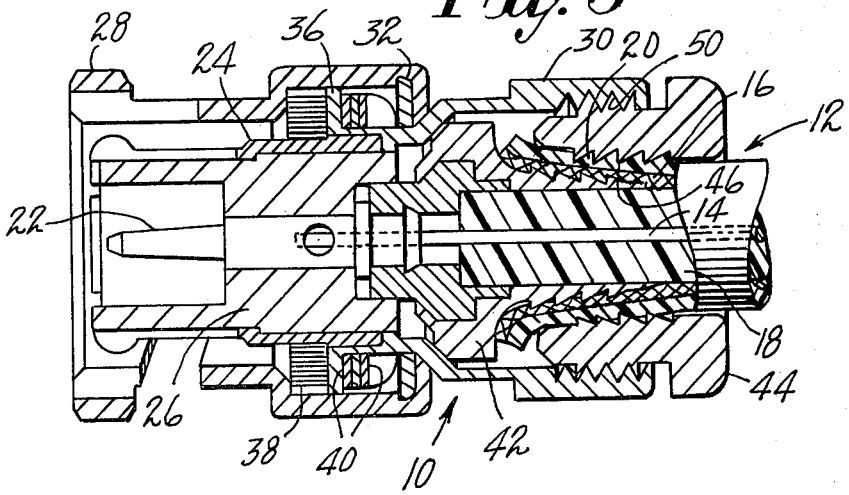
FIG. 3 is a view also in longitudinal section showing the connector of the previous Figures completely installed on the end of the cable.
Figure 4:
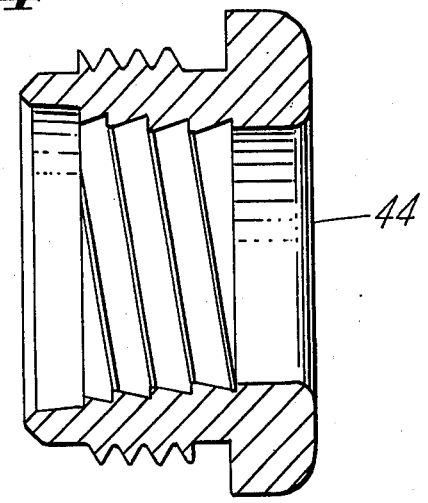
FIG. 4 is a detail view in longitudinal section of a threaded collar forming a part of the connector shown in the previous Figures.

Turning now to the drawings, there is shown, particularly in FIGS. 1 to 3, a connector assembly according to the present invention indicated generally at 10, and a coaxial cable indicated generally at 12. The cable 12 consists of a central conductor 14, an outer braided conductor 16, an insulator 18 and a sheath 20 which is usually a layer of rubber or rubber-like plastic.

The connector assembly depicted in the drawings is partly of conventional design, particularly at the left end intended to interconnect either with another connector on the end of a cable or with a stationary connector usually mounted on the cabinet of a piece of electronic equipment and serving either as the input or output to the equipment. The connector assembly comprises an inner conductor 22, an outer shell 24 and an insulator 26. Captive on the outside of the shell 24 is a bayonet sleeve 28 for coupling the connector assembly to a mating connector. As depicted in FIGS. 1 to 3, the shell 24 is a two-piece construction including a rear member 30 fixedly connected to the forward member by soldering or spinning. Alternatively, the shell may be manufactured in one piece. The sleeve 28 is free to rotate on the shell 24, being retained by a split washer 32 which is inserted into a groove in the sleeve and the end portion of the sleeve spun over the inserted washer. The rear member 30 of the shell is formed with a flange 36 against which a gasket 38 is seated in position to be engaged by the end of the mating connector to weatherproof the interior of the shell 24 when the two connectors are joined in operative relationship. To this end, a set of three spring washers 40 is interposed between the bottom of the sleeve 28 and the flange 36 to urge the gasket 38 against the end of the mating connector.

The parts and arrangement already described are of generally conventional design and may vary widely in shape and size depending on the mating part. For joining the connector to the coaxial cable, there is provided according to the present invention, a conical bushing 42 and a threaded collar 44. The bushing 42 is usually metallic or of other electrically conductive material and, by being inserted beneath the braided outer conductor 16, serves both to assist the collar 44 in anchoring the cable 12 to the connector assembly and also to provide an electrical connection between the conductor 16 and the shell 24. The bushing 42 is loosely fitted to the external diameter of the insulator 18 and its conical surface is grooved to form a series of shallow annular spurs which grip the interior of the conductor 16. The collar 44 is loosely fitted to the sheath 20 and internally formed with a taper generally matching the taper of the bushing 42 to provide parallel clamping of the insulator 18 and the sheath 20. The interior of the collar 44 is tapped to provide a single shallow tapered thread-like retaining form 46 which slightly penetrates the thickness of the sheath and thereby anchors the cable to the connector assembly. The holding power of the collar is enhanced by shaping the form 46 to a generally buttress thread profile including an essentially radial retaining forward face and an inclined trailing face, the included angle between the radial face and the inclined face being generally in the range of thirty to sixty degrees to assure a certain penetration depending upon the material of the sheath 20. The engagement and retention of the sheath 20 by the collar 44 is facilitated by threads 48 which are coupled to internal threads 50 in the interior enlarged portion 30 of the shell. In assessing the grip of the cone 42 and the collar 44 on the conductor 16 and the sheath 20, it should be realized that the depth of roughening on the cable-engaging surfaces has been exaggerated for clarity. In practice, the depth varies between three and ten thousandths inch depending on the operating frequency, the size of the connector and the degree of resistance to separation required by the particular application.

Figure 5:
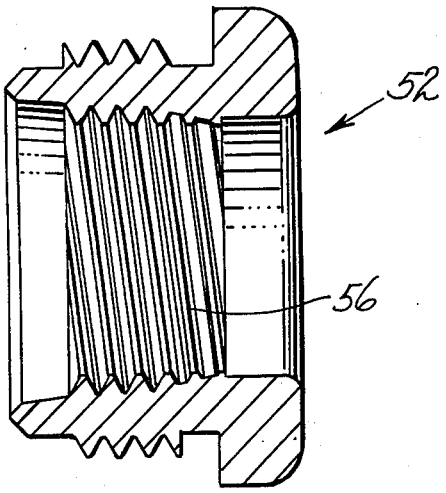
FIGS. 5 and 6 are detail views in longitudinal section of alternative forms of collars useful in connectors according to the present invention.
Figure 6:
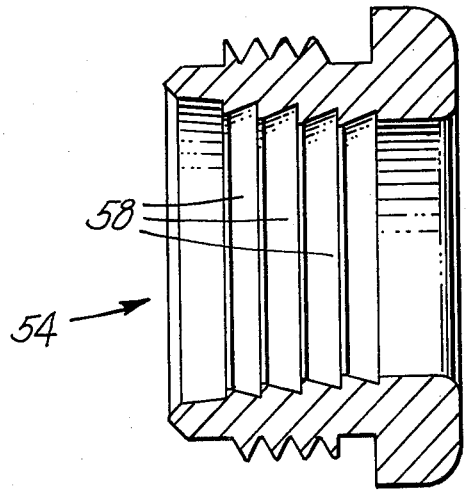

There are shown in FIGS. 5 and 6 collars indicated generally at 52 and 54 respectively which are formed with alternative interior surfaces also found to be useful for improving the cable-retaining capability of connectors. The collar 52 is interiorly formed by a tapered tap having a conventional sixty degree included angle profile 56. The collar 54 is provided with a sheath-retaining internal surface consisting of a plurality of annular grooves having the profile of a buttress thread such as that of the collar 44 but without the helical advance.

From the foregoing detailed description, many variations within the scope of the invention will become apparent to those of ordinary skill in the connector art. It is therefore not intended that the drawings and foregoing description be taken in a limiting sense but rather that the scope of the invention be interpreted from the appended claims.

Having thus disclosed my invention, what I claim as new and desire to secure by Letters Patent of the United States is:

1. A coaxial connector adapted to be mounted on the end of a coaxial cable having a central conductor, a braided outer conductor, an interposed insulator and a covering sheath of yielding, flexible material, the connector comprising a central conductor and an outer conductive shell respectively connectible electrically to the central conductor and the braided outer conductor of the coaxial cable, the shell having an internally threaded rearward end portion, a bushing having a conical exterior surface adapted to being inserted between the insulator and the braided outer conductor and formed with a plurality of retaining spurs spaced apart in the direction of the axis of the bushing and an externally threaded collar engaging the threads of the shell and formed with a textured interior, tapered in generally parallel relationship with the exterior surface of the bushing for applying a clamping force to the sheath of the cable whereby the textured interior of the collar penetrates and anchors in the covering sheath.

2. A coaxial connector according to claim 1 further characterized in that the interior of the collar is textured in a buttress profile having a generally radially oriented leading surface and an inclined trailing surface.

3. A coaxial connector according to claim 1 further characterized in that the texture on the interior of the collar has a profile arranged in a helical pattern.

4. A coaxial connector according to claim 1 further characterized in that the retaining spurs on the exterior of the bushing have a profile including a generally radial leading surface and an inclined trailing surface.

5. A coaxial connector according to claim 1 further characterized in that the interior of the collar is textured in a helical pattern having a buttress thread profile.

6. A coaxial connector according to claim 5 further characterized in that the thread profile includes a generally radially oriented leading surface and an inclined trailing surface.

7. A coaxial connector adapted to be mounted on the end of a coaxial cable having a central conductor, a braided outer conductor, an interposed insulator and a covering sheath of yielding, flexible material, the connector comprising a central conductor and an outer conductive shell respectively connectible electrically to the central conductor and the braided outer conductor of the coaxial cable, the shell having an internally threaded rearward end portion, a bushing having a conical exterior surface adapted to being inserted between the insulator and the braided outer conductor and an externally threaded collar engaging the threads of the shell and formed with an interior textured in a helically patterned buttress profile, whereby the buttress profile is indented and anchored into the covering sheath as the collar is engaged with the internal threads of the shell.

8. A coaxial connector according to claim 7 further characterized in that the buttress profile includes a generally radially oriented leading surface and an inclined trailing surface.

* * * * *